US012022908B2

(12) United States Patent
Stein et al.

(10) Patent No.: US 12,022,908 B2
(45) Date of Patent: Jul. 2, 2024

(54) KNITTED COMPONENT FOR AN ARTICLE OF FOOTWEAR WITH TWO OR MORE MATERIAL COMPOSITIONS

(71) Applicant: NIKE, Inc., Beaverton, OR (US)

(72) Inventors: Stacy M. Stein, Tigard, OR (US); Martin Vasilevski, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 12 days.

(21) Appl. No.: 17/227,603

(22) Filed: Apr. 12, 2021

(65) Prior Publication Data

US 2021/0227920 A1 Jul. 29, 2021

Related U.S. Application Data

(63) Continuation of application No. 15/969,980, filed on May 3, 2018, now abandoned.

(Continued)

(51) Int. Cl.

| | |
|---|---|
| ***A43B 1/04*** | (2022.01) |
| ***A43B 7/12*** | (2006.01) |
| ***A43B 13/04*** | (2006.01) |
| ***A43B 13/12*** | (2006.01) |
| ***A43B 13/16*** | (2006.01) |

(Continued)

(52) U.S. Cl.

CPC ..... *A43B 1/04* (2013.01); *A43B 7/12* (2013.01); *A43B 13/04* (2013.01); *A43B 13/125* (2013.01); *A43B 13/16* (2013.01); *A43B 13/28* (2013.01); *A43B 23/0215* (2013.01);

(Continued)

(58) Field of Classification Search

USPC ..... 36/87, 84

See application file for complete search history.

(56) References Cited

U.S. PATENT DOCUMENTS 8,595,878 B2 12/2013 Huffa et al.
2004/0118018 A1* 6/2004 Dua ..... A43B 1/14 36/3 A (Continued)

FOREIGN PATENT DOCUMENTS

WO 2015/068108 A1 5/2015

OTHER PUBLICATIONS

Chen Q, Zhao T. The thermal decomposition and heat release properties of the nylon/cotton, polyester/cotton and Nomex/cotton blend fabrics. Textile Research Journal. 2016;86(17):1859-1868. doi:10.1177/0040517515617423 (Year: 2016).*

(Continued)

*Primary Examiner* — Aiying Zhao

(74) *Attorney, Agent, or Firm* — Shook, Hardy & Bacon L.L.P.

(57) ABSTRACT

A knitted component for an article of footwear may have an overfoot portion and an underfoot portion, a first yarn, where the first yarn at least partially forms the overfoot portion and at least partially forms the underfoot portion, and a second yarn, where the second yarn at least partially forms the overfoot portion and at least partially forms the underfoot portion. The first yarn may include a first material composition with a first melting point and the second yarn may include a second material composition with a second melting point. The first melting point may be at least 20 degrees Celsius higher than the second melting point.

20 Claims, 9 Drawing Sheets

Related U.S. Application Data

(60) Provisional application No. 62/502,362, filed on May 5, 2017.

(51) Int. Cl.
*A43B 13/28* (2006.01)
*A43B 23/02* (2006.01)
*A43B 23/04* (2006.01)
*D04B 1/24* (2006.01)

(52) U.S. Cl.
CPC ..... *A43B 23/0275* (2013.01); *A43B 23/0295* (2013.01); *A43B 23/042* (2013.01); *D04B 1/24* (2013.01)

(56) References Cited

U.S. PATENT DOCUMENTS

2011/0283435 A1 11/2011 Smith et al.
2012/0246973 A1 10/2012 Dua
2013/0000148 A1 1/2013 Gellis
2013/0260104 A1 10/2013 Dua et al.
2014/0310983 A1* 10/2014 Tamm ..... A43B 23/0235 36/83
2014/0310986 A1* 10/2014 Tamm ..... A43B 13/14 12/142 T
2015/0107307 A1* 4/2015 Kosui ..... A43B 17/003 2/239
2015/0216253 A1* 8/2015 Podhajny ..... A43B 1/04 28/165
2015/0230546 A1 8/2015 Zasloff
2015/0313316 A1* 11/2015 Boucher ..... D04B 1/16 36/93
2015/0351483 A1 12/2015 Podhajny
2016/0278471 A1* 9/2016 Rossignoli ..... A43D 3/026
2017/0245581 A1* 8/2017 McFarland, II ..... A43B 1/04
2017/0245582 A1 8/2017 Green et al.
2018/0132558 A1 5/2018 Berrian et al.
2018/0317592 A1 11/2018 Rudolf et al.

OTHER PUBLICATIONS

Non-Final Office Action received for U.S. Appl. No. 15/969,980, dated Apr. 30, 2021, 16 pages.
Final Office Action received for U.S. Appl. No. 15/969,980, dated Aug. 30, 2021, 18 pages.
Intention to Grant received for European Patent Application No. 18726654.9, dated Sep. 2, 2021, 5 pages.
Extended European Search Report received for European Patent Application No. 21206709.4, dated Mar. 18, 2022, 8 pages.
Office action received for European Patent Application No. 21206709.4, dated Dec. 21, 2022, 7 pages.
Intention to Grant received for European Patent Application No. 21206709.4, dated Jul. 20, 2023, 7 pages.

* cited by examiner

KNITTED COMPONENT FOR AN ARTICLE OF FOOTWEAR WITH TWO OR MORE MATERIAL COMPOSITIONS

RELATED APPLICATIONS

This application claims the benefit of U.S. Nonprovisional application Ser. No. 15/969,980, entitled "Knitted Component For An Article of Footwear With Two or More Material Compositions" and filed May 3, 2018, which claims the benefit of U.S. Provisional Application No. 62/502,362, filed May 5, 2017, the entireties of which are incorporated herein by reference.

BACKGROUND

Conventional articles of footwear generally include two primary elements: an upper and a sole structure. The upper is secured to the sole structure and forms a void within the article of footwear for comfortably and securely receiving a foot. The sole structure is secured to a lower surface of the upper so as to be positioned between the upper and the ground. In some articles of footwear, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. An ankle opening in a heel area generally provides access to the void in the interior of the upper. A lacing system is often incorporated into the upper to adjust the fit of the upper, thereby facilitating entry and removal of the foot from the void within the upper. The upper may include a tongue that extends under the lacing system to enhance adjustability of the footwear, and the upper may incorporate a heel counter to limit movement of the heel.

BRIEF SUMMARY

One general aspect of the present disclosure includes a knitted component for an article of footwear, the knitted component having an overfoot portion and an underfoot portion, a first yarn, where the first yarn at least partially forms the overfoot portion and at least partially forms the underfoot portion, and a second yarn, where the second yarn at least partially forms the overfoot portion and at least partially forms the underfoot portion. The first yarn may include a first material composition with a first melting point and the second yarn may include a second material composition with a second melting point. The first melting point may be at least 20 degrees Celsius higher than the second melting point.

Another general aspect of the present disclosure includes a knitted component with an overfoot portion, a first underfoot section extending from a first side of the overfoot portion, the first underfoot section having a first end, and a second underfoot section extending from a second side of the overfoot portion, the second underfoot section having a second end. The first end may be configured to secure to the second end such that the first underfoot section and the second underfoot section form an underfoot portion of an article of footwear, where at least one of the first underfoot section and the second underfoot section is formed by both of a first material composition and a second material composition, and where the first material composition and the second material composition have different melting points.

Another general aspect of the present disclosure includes an article of footwear with a knitted component having an overfoot portion and an underfoot portion. The knitted component may have a fused area located at least partially on the underfoot portion, where the fused area is at least partially formed by a first yarn and a second yarn, where the first yarn includes a first material composition having a first melting point, where the second yarn includes a second material composition having a second melting point, and where the first melting point is at least 20 degrees Celsius higher than the second melting point.

Another general aspect of the present disclosure includes a knitted component with a first area located between a second area and a third area, where the first area has a first number of courses per unit length, where the second area has a second number of courses per unit length, and where the third area has a third number of courses per unit length. The first number of courses per unit length may be less than the second number of courses per unit length and the third number of courses per unit length such that the first area of the knitted component includes a tendency to curve.

DETAILED DESCRIPTION

Figure 1:
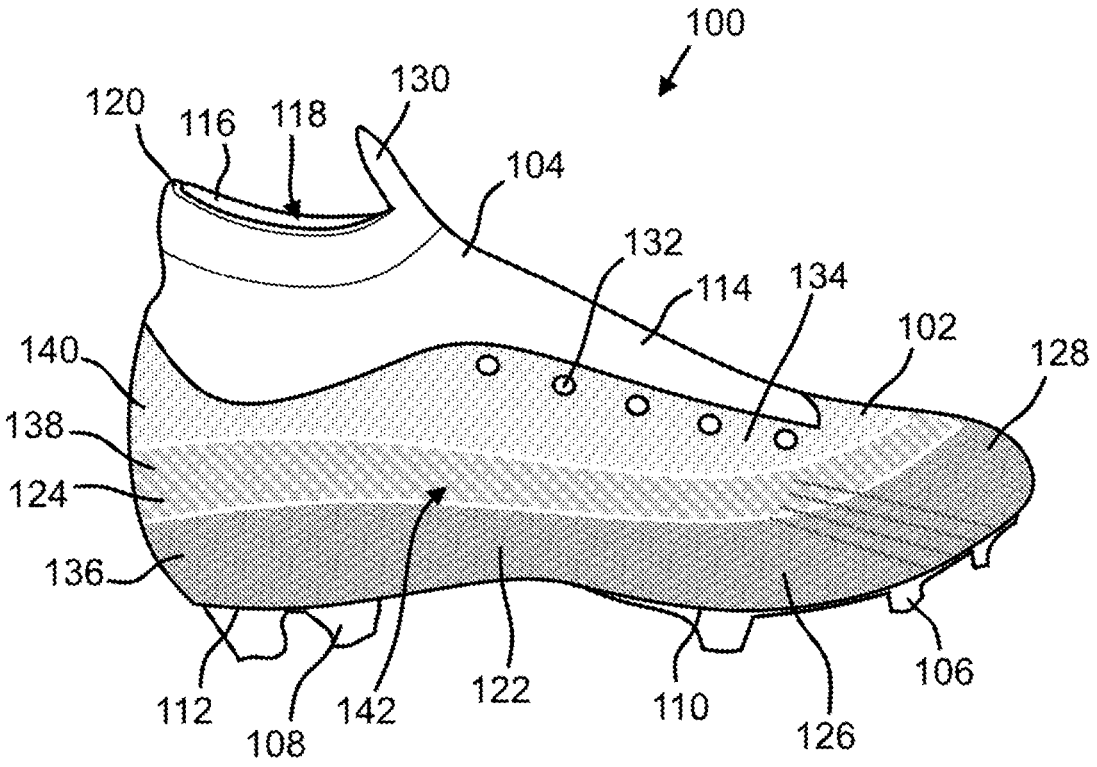
FIG. 1 is an illustration showing a side view of an article of footwear in accordance with an embodiment of the present disclosure.

Various aspects are described below with reference to the drawings in which like elements generally are identified by like numerals. The relationship and functioning of the various elements may better be understood by reference to the following description. However, aspects are not limited to those illustrated in the drawings or explicitly described below. It also should be understood that the drawings are not necessarily to scale, and in certain instances, details may have been omitted that are not necessary for an understanding of aspects disclosed herein.

Certain aspects of the present disclosure relate to knitted or other textiles for use in articles, and in particular for use in uppers configured an article of footwear. The uppers may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The uppers may also be incorporated into non-athletic footwear and shoes, such as dress shoes, loafers, and sandals.

FIG. 1 is an illustration showing an article of footwear 100 formed with an upper 102, where the upper 102 is substantially formed as a knitted component 104. As shown, the upper 102 may be secured to at least one sole structure, such as the first sole structure 106 and the second sole structure 108. A first biteline 110 may be located where an edge of the first sole structure 106 joins the upper 102 and a second biteline 112 may be located where an edge of the second sole structure joins the upper 102. The upper 102 may be joined to at least one of the sole structures in a fixed manner using any suitable technique, such as through the use of an adhesive, by sewing, etc.

The knitted component 104 may additionally include a throat area 114 extending from and an ankle opening 116 leading to a void 118, and a collar 120 may at least partially surround the ankle opening 116. The void 118 of the article of footwear 100 may be configured (e.g., sized and shaped) to receive and accommodate a foot of a person. The throat area 114 may be generally disposed in a midfoot area 122 of the upper 102. The midfoot area 122 of the upper 102 may be located between a heel area 124 and a forefoot area 126 (which may include a toe area 128). In some embodiments, an optional tongue such as the depicted tongue 130 may be disposed in the throat area 114. The tongue 130 may be any type of tongue, such as a gusseted tongue or a burrito tongue.

The article of footwear 100 may include a fastening element (not shown). Any suitable type of fastening element may be used, such as a shoelace, a cable-tensioning system, and/or any other suitable device. The upper 102 may be configured to secure to and communicate with the fastening element such that the fastening element may adjust and/or tighten the upper 102 around a foot of a wearer. For example, the upper 102 may include a set of apertures 132 for receiving the fastening element, but other suitable element(s) for communication with a fastening system may alternatively be used.

At least a portion of the upper 102, and potentially substantially the entirety of the upper 102, may be formed of the knitted component 104 (or another suitable textile component). The knitted component 104 may be formed as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted component 104 without the need for significant post-knitting processes or steps. Alternatively, two or more portions of the knitted component 104 may be formed separately as distinct integral one-piece elements and then the respective elements attached.

Forming the upper 102 with the knitted component 104 may provide the upper 102 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The knitted component 104 may also provide desirable aesthetic characteristics by incorporating yarns having different colors, textures or other visual properties arranged in a particular pattern. The yarns themselves and/or the knit structure formed by one or more of the yarns of the knitted component 104 may be varied at different locations such that the knitted component 104 has two or more portions with different properties (e.g., a portion forming the throat area 114 of the upper 102 may be relatively elastic while another portion may be relatively inelastic). In some embodiments, the knitted component 104 may incorporate one or more materials with properties that change in response to a stimulus (e.g., temperature, moisture, electrical current, magnetic field, or light). For example, the knitted component 104 may include yarns formed of at least one thermoplastic polymer material or material composition (e.g., at least one polyurethane, polyamide, polyolefin, and/or nylon) that transitions from a solid state to a softened or liquid state when subjected to certain temperatures at or above its melting point and then transitions back to the solid state when cooled. The one or more thermoplastic polymer materials may provide the ability to heat-process (e.g., heat and then cool) at least a portion of the knitted component 104 to thereby form an area of bonded or continuous material (herein referred to as a "fused area" and depicted as fused area 134) that exhibits certain advantageous properties, including a relatively high degree of rigidity, strength, and water resistance, for example. In this description, the term "fused area" generally means an area of the upper 102 where portions of material forming the upper (e.g., material initially included with distinct individual yarns of the knitted component 104) are partially or substantially bonded together. A "fused area" is not required to be formed by any specific process. In a non-limiting example, two or more separate yarns, including monofilament and/or multifilament yarn, may form a fused area when at least a portion of the material initially included with the yarns is bonded such that at least a portion of the separate yarns become continuous with one another. Further, after bonding to form a fused area, the material of the initially-separate yarns may become visually and/or physically indistinguishable, but this is not the case in all embodiments.

The fused area 134 may have any suitable size and shape, and the upper 102 may have multiple fused areas (which may be discrete and separated by areas absent of fused material). As shown, the fused area 134 may have different regions (such as a first region 136, a second region 138, and a third region 140) that have different properties. For example, a first region 136 may have a relatively high density of fused material (defined as the amount (mass) of fused thermoplastic polymer material composition(s) per unit of surface area) such that it has a relatively low elasticity, low rigidity, high strength, and high water resistance. A second region 138 may have a lower density of fused material than the first region 136, and thus may be more elastic, potentially less rigid, and potentially less water resistant than the first region 136. Similarly, a third region may have a lower density of fused material than the first region 136 and the second region 138. More or less than three regions may be included, and the specific orientation, order, and location of each of the regions of FIG. 1 are included as a non-limiting example only.

The fused area 134 may define a portion of an outer surface 142 of the upper 102. In at least some locations of the knitted component 104, the fused area 134 may be substantially limited to the outer surface 142 of the knitted component 104, and an inner surface (shown in FIG. 6) may not include the fused area 134. The inner surface of the knitted component may face opposite the outer surface 142 and may at least partially form a void 118 of the article of footwear. In other words, the inner surface may be located between the outer surface 142 and the void 118 (such that the fused area 134 is separated from the void at least at one location, for example). Advantageously, the inner surface may include softness, anti-abrasiveness, and other comfort-related properties that may be associated with the knitted component 104 in areas where the fused area 134 is absent. A multi-layer knitted component with a fused area located on an outer surface (but not necessarily an inner surface) is fully described in U.S. patent application Ser. No. 15/443,808, filed Feb. 27, 2017, which is herein incorporated by reference in its entirety.

When a thermoplastic polymer material or composition is included with a yarn, any portion of the yarn may have one or more thermoplastic polymers (collectively "the thermoplastic polymer material composition"), and in some embodiments, substantially the entirety of the yarn may be formed of the thermoplastic polymer material composition. Optionally, a yarn may have a polyester core and a thermoplastic polymer sheath. The thermoplastic polymer material composition of the sheath may have a melting temperature less than the melting temperature or decomposition temperature of the polyester core. For example, the melting temperature of the thermoplastic polymer material composition may have a melting temperature of approximately 100 degrees Celsius less than the melting temperature of the polyester core in some embodiments, though any other suitable difference in melting temperatures is contemplated. All melting points and other temperatures referenced herein are approximate, and based on atmospheric pressure at sea level. In one example, the melting temperature of the polyester core may be about 260 degrees Celsius, and the decomposition temperature may be about 350 degrees Celsius or greater. The melting temperature of the thermoplastic polymer material composition may be, for example, between about 80 degrees Celsius and about 200 degrees Celsius, such as from about 120 degrees Celsius to about 180 degrees Celsius. In an exemplary embodiment, the yarn may include a thermoplastic polyurethane, which may be specifically marketed as a Dream-Sil® thermoplastic polyurethane coated yarn manufactured by Sambu Fine Chemical Co., LTD.

Figure 2:
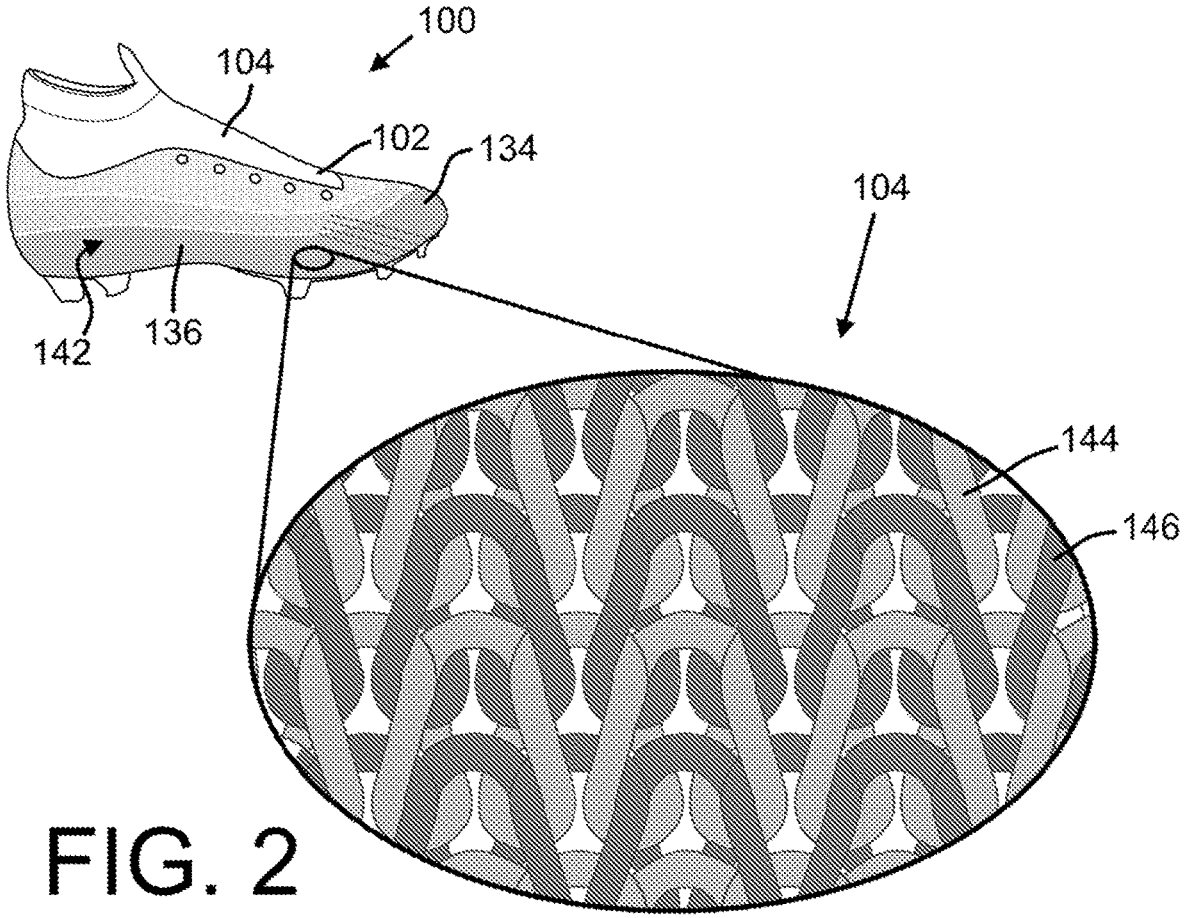
FIG. 2 is an illustration showing a magnified view of a first region of an outer surface of the article of footwear of FIG. 1.

FIG. 2 is an illustration showing a magnified view of a first region 136 of the fused area 134. As shown in FIG. 2, in some embodiments, more than one thermoplastic polymer material composition may be included. For example, when the upper 102 is formed of a knitted component 104, the knitted component 104 may include more than one yarn type, where different yarn types include different material compositions. Thus, it is contemplated that the knitted component 104 may include a first yarn 144 including a first material composition and a second yarn 146 having a second material composition, where the first material composition and the second material composition have different melting points. In the example depicted in FIG. 2, the first region 136 includes a plurality of first courses each comprising the first yarn 144 and a plurality of second courses each comprising the second yarn 146, where the plurality of first courses alternate with the plurality of second courses. In one non-limiting exemplary embodiment, the first material composition may include a composition of a thermoplastic polyurethane material with a melting point of about 140 degrees or less, such as about 120 degrees Celsius. The second material composition may include a different composition of a thermoplastic polyurethane material with a melting point of about 195 degrees Celsius or less, such as about 175 degrees Celsius. Thus, the second melting point may be higher than the first melting point (e.g., at least 5 degrees Celsius higher, at least 10 degrees Celsius higher, at least 20 degrees Celsius higher, at least 50 degrees Celsius higher, at least 100 degrees Celsius higher, or even higher). Other suitable material compositions with different melting points may additionally or alternatively be included.

Including multiple thermoplastic polymer material compositions may be advantageous for providing the upper with desirable characteristics that may be difficult to achieve when using only one composition. For example, a fused area formed with a thermoplastic polymer material composition with a relatively low melting point (e.g., 120 degrees Celsius) may have desirable water-resistance properties, but it may be susceptible to abrasion. A thermoplastic polymer material composition with a higher melting temperature (e.g., 175 degrees Celsius) may lack the desirable degree of water resistance but may be associated with a high degree of resistance to abrasion. Thus, by including both material compositions in a fused area, the fused area may have desirable water-resistance characteristics and also desirable abrasion resistance. While this paragraph uses abrasion resistance and water-resistance as examples, other characteristics may additionally or alternatively be associated with fused areas formed particular material compositions with particular melting points.

In the first region 136, the ratio of one material composition to another (measured as the ratio of the mass of one material composition to another, per unit of surface area) may be any suitable ratio. For example, in some non-limiting exemplary embodiments, the ratio of the first thermoplastic polymer material composition (of the first yarn 144) to the second thermoplastic polymer material composition (of the second yarn 146) may be about 1:1, but other ratios are also contemplated (e.g., 1:0.1, 1:0.25, 1:0.5, 1:0.75, 1:1, 1:1.5, 1:2, 1:5, 1:10, etc.). The ratio may be determined by the amount of first yarn 144 used with respect to the amount of second yarn 146, the amount of the first thermoplastic polymer material composition per unit length of the first yarn 144 and/or the amount of the second thermoplastic polymer material composition per unit length of the second yarn 146, etc. Further, the ratio of one material composition to another may vary throughout the article of footwear 100, and even throughout the first region 136 of the fused area 134, particularly when different characteristics (e.g., requiring different material compositions) are desired at different locations within the fused area 134.

Figure 3:
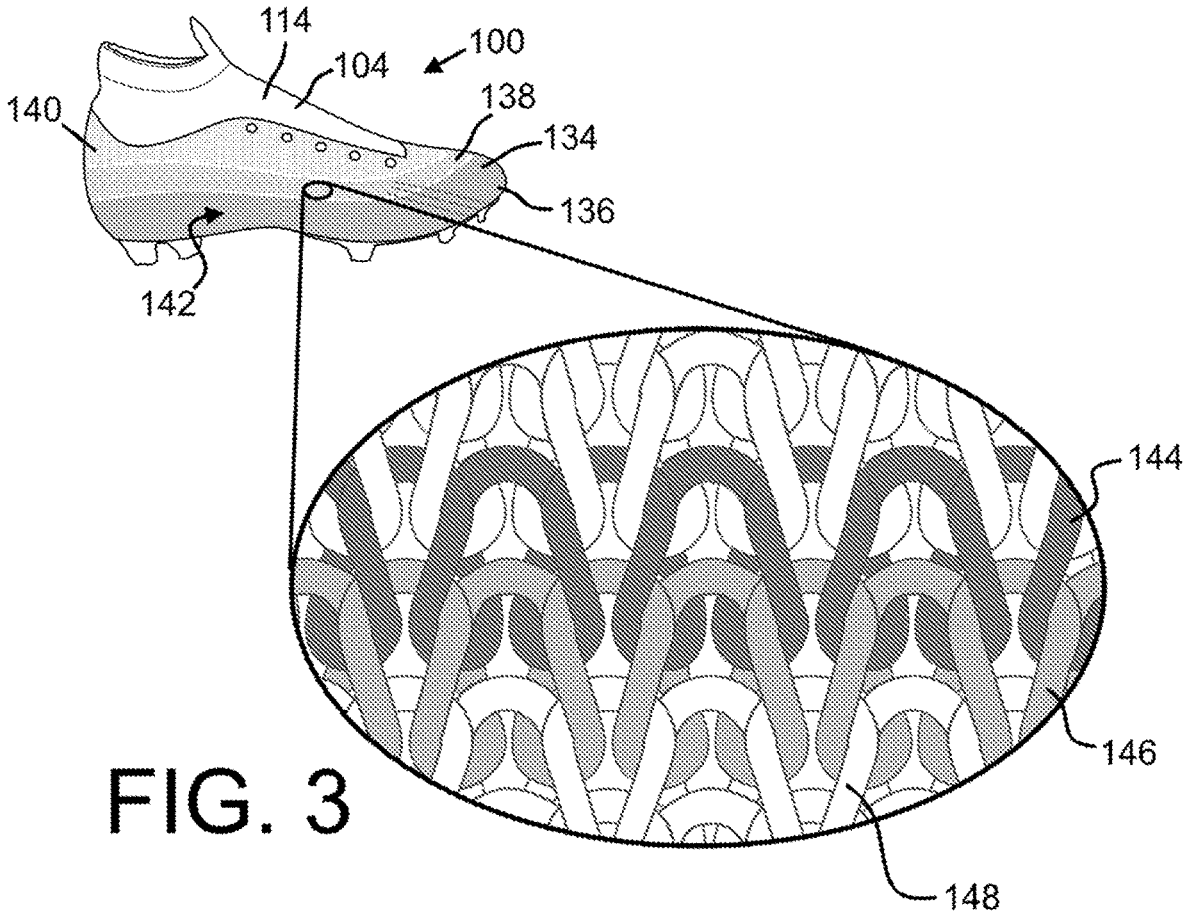
FIG. 3 is an illustration showing a magnified view of another region of an outer surface of the article of footwear of FIG. 1.

FIG. 3 is an illustration showing a magnified view of the second region 138 of the fused area 134. As shown, in the second region 138, the amount of the first thermoplastic polymer material composition per unit surface area may be less than in the first region 136, which may be due to less of the first yarn 144 being used in the second region 138 than in the first region 136 (per unit surface area). Similarly, the amount of the second thermoplastic polymer material composition per unit surface area may be less in the second region 138 than in the first region 136. In other words, a density of the first thermoplastic polymer material composition and a density of the second thermoplastic polymer composition may each be less in the second region 138 than in the first region 136. The knitted component 104 may also include a third yarn 148 formed of a third material composition other than the first material composition and the second material composition. As shown in FIG. 3, the second region 138 may include the third yarn 148. In one example, the third yarn 148 may be substantially formed of a material that has a melting point (e.g., if it is a thermoplastic polymer material) and/or a decomposition point (e.g., if it is a thermoset material) that is higher than the melting point of the first yarn 144 and the second yarn 146. Illustrative, non-limiting examples of materials that may form the third yarn 148 include thermoset polymeric materials and natural fibers such as cotton, silk, and wool, or thermoplastic polymer materials with a relatively high melting point, such as a polyester. When subjected to moderate levels of heat, these materials tend to remain stable. It is noted that references to the first yarn 144 and the second yarn 146 as being formed of a thermoplastic polymer material composition herein do not limit the third yarn 148 from also being a separate thermoplastic polymer material composition with an even higher melting point even when the third yarn 148 will generally not form a fused area when heat processed in accordance with this disclosure.

Advantageously, the relatively high melting point and/or decomposition point of the third yarn 148 may dictate that the third yarn 148 remains relatively stable when the first yarn and/or the second yarn are heat processed. Thus, the general properties that the third yarn has before the heat processing step may be retained during and after heat processing. In some embodiments, the third yarn 148 may have a melting point and/or a decomposition temperature of about 140 degrees Celsius or higher, about 175 degrees Celsius or higher, about 200 degrees Celsius or higher, about 250 degrees Celsius or higher, or even higher. One specific example is a yarn formed substantially of a polyester, which may have a melting point of about 250 degree Celsius and a boiling or decomposition point of about 350 degrees Celsius.

When the knitted component 104 includes a knit structure formed on two needle beds (e.g., a double jersey knit structure), the material ratios may be varied by varying the yarns that are exposed on the outer surface 142. For example, in the first region 136 of the fused area 134, the third yarn 148 may be primarily knitted on a back needle bed of a knitting machine such that it is located primarily on an inner side of the knitted component. In the second region 138, a greater portion of the third yarn 148 may be incorporated into the outer side of the knitted component 104 (e.g., by knitting the third yarn 148 with a front needle bed of the knitting machine), while a greater portion of the first yarn 144 and/or the second yarn 146 may be incorporated into the inner side. A process for varying amounts of different yarn types on respective sides of a component is fully described in U.S. patent application Ser. No. 15/443,808 (which is incorporated by reference in this description above).

Referring to FIG. 1, in some embodiments, the ratio of fused to non-fused material present in regions of the knitted component 104 may vary. For example, the amount and/or density of fused thermoplastic polymer material composition(s) may decrease when moving from the biteline towards the throat area 114. To illustrate, the first region 136 may be primarily formed of thermoplastic polymer material composition(s) that are fused. In a second region 138, the knitted component 104 may include a relatively reduced amount of the thermoplastic polymer material composition(s), and the third region 140 may include even less of the fused thermoplastic polymer material(s) than the second region 138. In one non-limiting example, the ratio of the fused thermoplastic polymer material compositions to other material may be about 90:10 (or greater) in the depicted first region 136, about 50:50 in the second region 138, and about 25:75 in the third region 140. Other ratios in the first region 136, the second region 138, and/or the third region 140 are contemplated. It is further contemplated that one or more of the regions may gradually decrease in ratio of fused material to another material in a gradient, and in some embodiments the different regions may not be discrete and/or may not be not visually or otherwise discernable.

It is also contemplated that instead of (or in addition to) varying the amount of the thermoplastic polymer material, different areas of the knitted component 104 having the thermoplastic polymer material composition(s) may be processed differently (e.g., more heat and/or pressure may be administered in one or more regions than others). In some embodiments, some selected regions of the knitted component 104 may not form a fused area at all even when including thermoplastic polymer material composition(s). For example, if the knitted component 104 includes thermoplastic polymer material composition(s) in areas where characteristics associated with a fused area are not desired, those areas may be shielded from heat during the heat processing step, for example.

Figure 4:
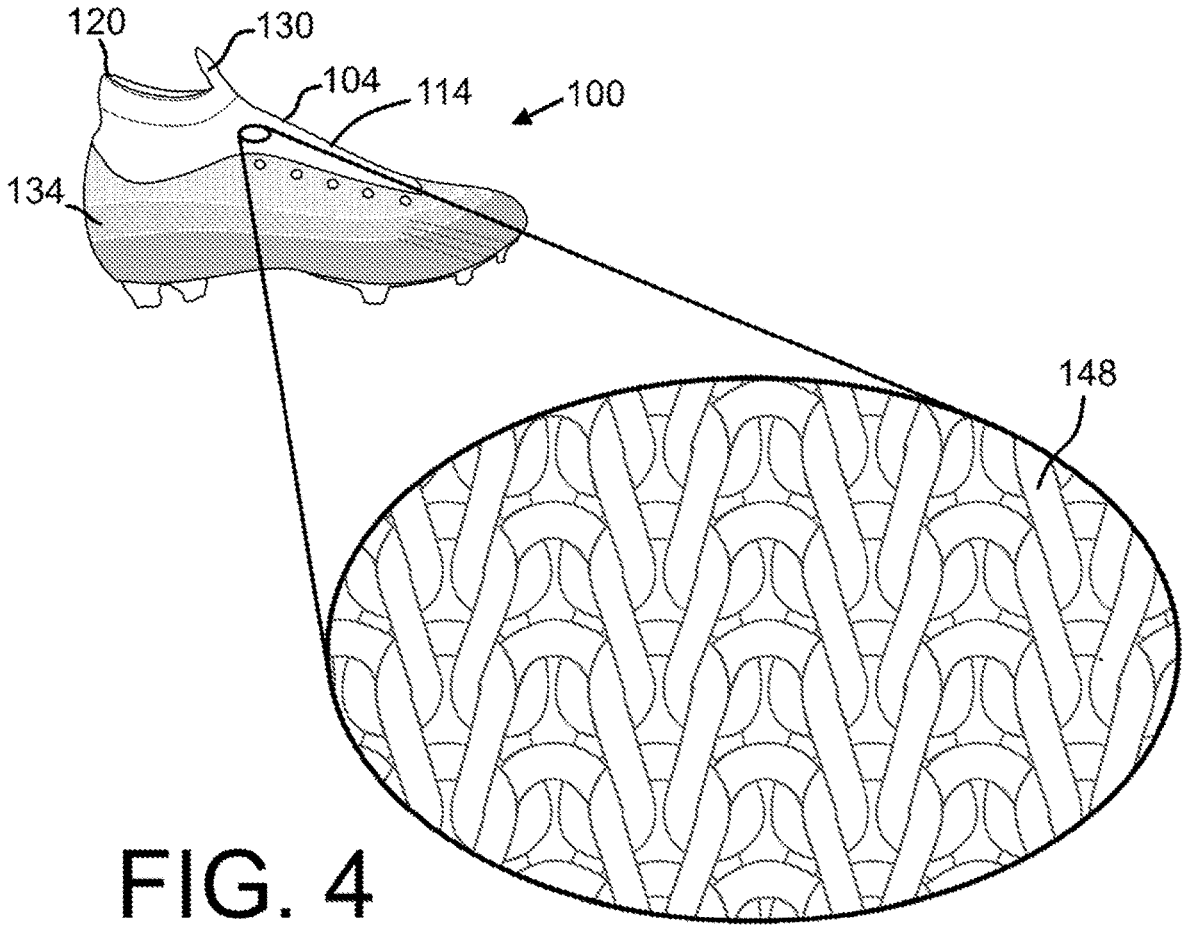
FIG. 4 is an illustration showing a magnified view of yet another region of an outer surface of the article of footwear of FIG. 1.

FIG. 4 is an illustration showing a magnified view of the throat area 114. The outer surface of the knitted component 104 at the throat area 114 may be fully formed of third yarn 148 (and/or may include non-fused portions of the first yarn 144 and/or the second yarn 146). Advantageously, the throat area 114 may include a desirable elasticity for providing the article of footwear 100 with a comfortable and/or adjustable fit around a foot of a wearer. At least one surface of the throat area 114 may be primarily formed of polyester, but other suitable materials may additionally or alternatively be included. Similarly, the collar 120 and/or a tongue 130 of the knitted component 104 may exclude the fused area 134 such that they have a relatively high degree of elasticity, flexibility, resiliency, breathability, adjustability, softness and anti-abrasiveness, and/or other desirable characteristics for receiving a foot and providing a comfortable and/or adjustable fit. Other areas of the upper 102 may additionally or alternatively exclude a fused area. It is contemplated that these areas may be covered by a film (e.g., a spray-on or stick-on film) to protect the knitted component from abrasion (especially on the outer surface), but such a film is optional.

Figure 5:
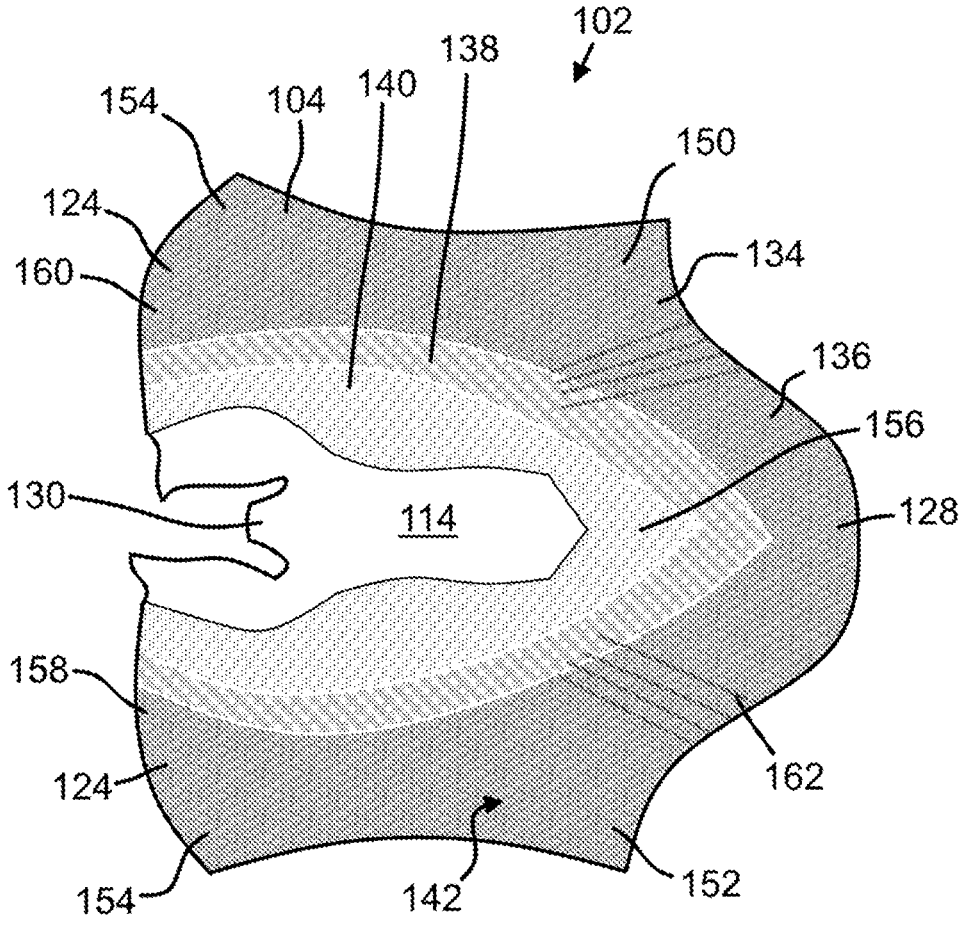
FIG. 5 is an illustration showing an embodiment of a knitted component for forming an upper for the article of footwear of FIG. 1.

FIG. 5 shows the knitted component 104 of the upper 102 as it may appear after the knitting process (e.g., after leaving a flat-bed knitting machine) but before being manipulated into its wearable shape. Optionally, the knitted component 104 may be cut into its desired shape after knitting, but in some embodiments no cutting is required. The knitted component 104 may be heat-processed prior to being manipulated into its wearable shape to form the first region 136, the second region 138, and/or the third region 140 of the fused area 134. Heat-processing after the knitting step, but before manipulating the upper 102 into its wearable shape may be advantageous since utilizing a heat press or other device may be relatively easily accomplished and relatively efficient when the knitted component 104 is substantially flat. One method of heat-processing a knitted component that may be used to form the fused area 134 is fully described in U.S. patent application Ser. No. 15/443,808 (which is incorporated by reference above).

As shown, the knitted component 104 may include at least one underfoot section, such as a depicted medial underfoot section 150 and a lateral underfoot section 152. The medial underfoot section 150 and the lateral underfoot section 152 may be configured (e.g., sized, shaped, and positioned) to form an underfoot portion 154 of the article of footwear. The underfoot portion 154 (shown also in FIG. 7) may be associated with a plantar aspect of the foot (also known as the sole or bottom of a foot). The remainder of the knitted component 104 may be configured to form an overfoot portion 156 associated with the remainder of the foot, including the dorsal surface (i.e., the top of the foot). The underfoot portion 154 may extend from a lateral side 158 of the upper 102 to a medial side 160 of the upper and from the toe area 128 to the heel area 124.

In some embodiments, the heat-processing step may double as a step of molding at least one rib structure 162 or other feature within the fused area 134. Thus, it is contemplated that a heat press utilized for the heat processing step may have at least one mold, or alternatively a separate mold may be applied to the thermoplastic polymer material compositions during or after applying heat. The rib structure 162 may be advantageous for providing the fused area 134 with desirable surface characteristics. For example, the rib structure 162 may be configured (e.g., sized, shaped, and positioned) to provide grip or to provide another desirable function when performing an athletic activity (e.g., when kicking a ball). The rib structure 162 or other molded structures may additionally or alternatively provide desirable aesthetics to the outer surface 142 of the knitted component 104. In some embodiments, a logo, a label, or another suitable image or design may be molded within the fused area 134.

The fused area 134 may be located at least partially on the underfoot portion 154 and on the overfoot portion 156. As shown, the fused area 134 may extend on the underfoot portion 154, up the overfoot portion 156, and terminate at an edge of the throat area 114. In some embodiments (as depicted), the fused area 134 may substantially cover the entirety of the underfoot portion 154. Advantageously, the fused area 134 may provide the underfoot portion 154 with desirable characteristics associated with the fused area 134, such as suitable strength, durability, flexibility, water permeability, stretchability, and the like. Since the underfoot portion 154 may bear the weight of the wearer when in use, the fused area 134 may be particularly thick and/or dense on the underfoot portion 154 with respect to other locations to provide a relatively high degree of support, durability, protection and even cushioning between the ground and the plantar aspect of the foot. For example, during heat processing, it is contemplated that the hottest portion of a heat press may be applied to the underfoot portion 154 (since melted thermoplastic polymer material has a tendency to flow towards heat), thereby facilitating a dense and/or thick fused area 134 at the underfoot portion 154.

Figure 6:
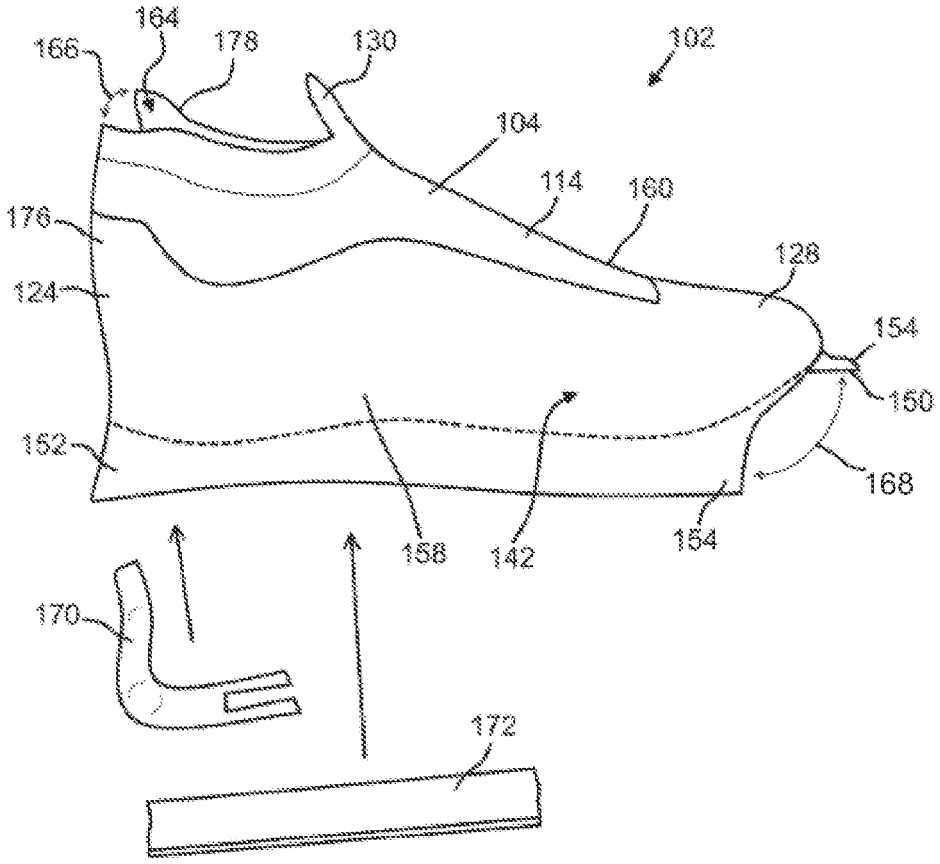
FIG. 6 is an illustration showing the knitted component of FIG. 5 being manipulated into a wearable shape.

FIG. 6 is an illustration showing the knitted component 104 being folded or otherwise manipulated into a wearable shape. As shown, the outer surface 142 formed by the knitted component 104 may face outwards, and an inner surface 164 may face inwards and eventually define the void of the article of footwear. A lateral heel area 176 and a medial heel area 178 may be coupled at this step to form a heel seem 166 in the heel area 124. Connecting the lateral heel area 176 to the medial heel area 178 at the heel seem 166 may include sewing, adhesive bonding, heat bonding, welding, using a mechanical clamp, or any other suitable device or method, and it is contemplated that another device may be placed between the medial heel area 178 and the lateral heel area 176. The folding/manipulating step, and/or the step of forming the heel seem 166, may be at least partially performed when the upper 102 is located on a last. An example of a last and an associated lasting process is described in in U.S. patent application Ser. No. 12/848,352, filed Aug. 2, 2010, and issued as U.S. Pat. No. 8,595,878, which is herein incorporated by reference in its entirety.

Similarly, the lateral underfoot section 152 and the medial underfoot section 150 may be coupled at this step to form an underfoot seam 168 on the underfoot portion 154 of the upper 102. Connecting the lateral underfoot section 152 to the medial underfoot section 150 may include sewing, adhesive bonding, heat bonding, welding, using a mechanical clamp, or any other suitable device or method, and it is contemplated that another device may be placed between the medial underfoot section 150 and the lateral underfoot section 152. The folding/manipulating step, and/or the step of forming the underfoot seam 168, may be at least partially performed when the upper 102 is located on a last (not shown).

Before, during, or after folding the step of manipulating the knitted component 104 into is wearable shape, one or more insert elements may be included. For example, a chassis 170 may be included for facilitating retention of the wearable shape of the upper 102. The chassis 170 may be secured to the knitted component (e.g., by sewing, using an adhesive, etc.) and may provide suitable structure, durability, strength, rigidity, etc., particularly in the heel area 124 and the underfoot portion 154 (but also additionally or alternatively in other areas). In some embodiments, the chassis 170 may be coupled to a last during the lasting step and then de-coupled from the last when the upper 102 is removed from the last. A second insert element 172 may be included for providing cushioning, for facilitating the connection of the lateral underfoot section 152 to the medial underfoot section 150, or for any other suitable purpose. More or fewer than two insert elements may be included for a wide wage of functions.

As shown in FIG. 6, the tongue 130 and/or the throat area 114 of the knitted component 104 may be may include a knit structure such that the tongue 130 has a tendency to curve. The tongue 130 may be configured to be pulled by a user to facilitate placing a foot in the upper 102. As such, the tongue 130 may include a tendency to curve away from a leg of the user such that it can easily and efficiently be located and grasped. The tendency to curve may be formed by any suitable knit structure (or otherwise). For example, the tendency to curve may be provided by providing more courses on one surface (e.g., a bottom surface) of the tongue 130 than another surface (e.g., a top surface) such that the tension in the top surface is higher than in the bottom surface when the tongue 130 is forced in to a flat state. This structure and an associated knitting process is described fully in U.S. Provisional Patent Application No. 62/421,850, filed Nov. 14, 2016, which is herein incorporated by reference in its entirety.

Additionally or alternatively, the throat area 114 may include less courses than at least a portion of one of the lateral side 158 and the medial side 160 of the knitted component located immediately adjacent to the throat area 114. For example, for every two courses of the lateral side 158 and/or the medial side, the throat area 114 may include one course. Other ratios are also contemplated (e.g., the ratio of courses of the throat area to an adjacent portion may be about 0.1:1, 0.2:1, 0.5:1, 0.8:1, etc.). The resulting knitted component 104 may, at least when the knitted component is forced into a flattened state, have a structure providing a tension in the yarns of the throat area 114 that is higher than a tension in surrounding yarns due to fewer courses covering substantially the same distance (i.e., the distance along the knitting direction). The higher tension in the tongue 130 and/or the throat area 114 may be equalized when the knitted component 104 deforms in a manner such that the tongue 130 is pulled upwards, and thus a natural tendency may be included within the knit structure for curving the tongue 130. This feature may be enhanced when the throat area 114 and/or the tongue 130 are formed of yarns having a relatively high elasticity. It may therefore be advantageous for the throat area 114 and/or the tongue 130 to include at least one yarn that is more elastic (either before or after heat processing) than the yarns primarily forming the lateral side 158 and/or the medial side 160 of the knitted component 104. Similarly, since heat processing the lateral and medial sides to form the fused area 134 may increase the rigidity and decrease the flexibility of the lateral side 158 and the medial side 160, forming the fused area 134 may enhance the tendency of the tongue 130 to curve.

Figure 7:
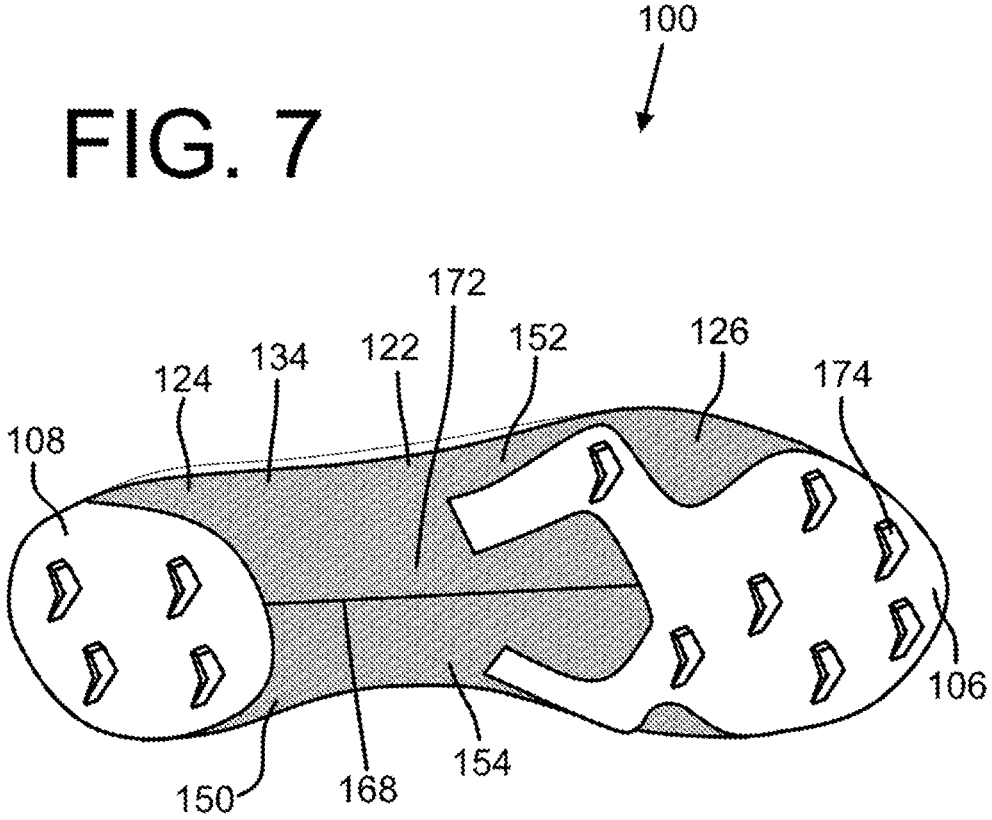
FIG. 7 is an illustration showing a bottom view of the article of footwear of FIG. 1.

FIG. 7 is an illustration showing a bottom view of the article of footwear 100. As shown, the underfoot seam 168 may be located on the underfoot portion 154 where the lateral underfoot section 152 and the medial underfoot section 150 are secured. The underfoot seam 168 may be approximately in the center of the underfoot portion 154 and may extend along the longitudinal direction of the article of footwear 100, but in other embodiments, the underfoot seam 168 may be offset with respect to the center of the underfoot portion 154 and/or may extend or otherwise be oriented in a different direction.

The underfoot portion 154 may be configured to attach to at least one sole structure (such as the first sole structure 106 and/or the second sole structure 108). The underfoot portion 154 may be joined to the first sole structure 106 and/or the second sole structure 108 using any suitable technique, such as through the use of an adhesive, by sewing, bonding, welding, etc. As such, the underfoot portion 154 may be formed with specific yarns and/or knit structures such that the underfoot portion 154 has suitable surface characteristics for sufficient bonding and support for a sole structure. The first sole structure 106 and the second sole structure 108 may be located in the forefoot area 126 and the heel area 124 of the underfoot portion 154, respectively. These respective locations may be advantageous since the forefoot area 126 and the heel area 124 are often the primary contacts with the ground when the article of footwear is in normal use.

As shown, the underfoot portion 154 may include an exposed area 172 where the knitted component 104 faces the ground and is not covered by a sole structure. Advantageously, the exposed area 172 may provide desirable flexibility and/or other desirable characteristics in the midfoot area 122 (or another location) such that the article of footwear 100 can flex, stretch, etc. (e.g., during running). It is also contemplated that the exposed area 172 of the underfoot portion 154 may be configured to directly contact the ground in some circumstances, such as when the cleats 174 of at least one of the first sole structure 106 and the second sole structure 108 are embedded in the ground. Thus, the fused area 134 may be sufficiently strong, durable, protective, or otherwise configured to serve as the bottom terminal surface of the article of footwear at least at one location of the underfoot portion 154.

Figure 8:
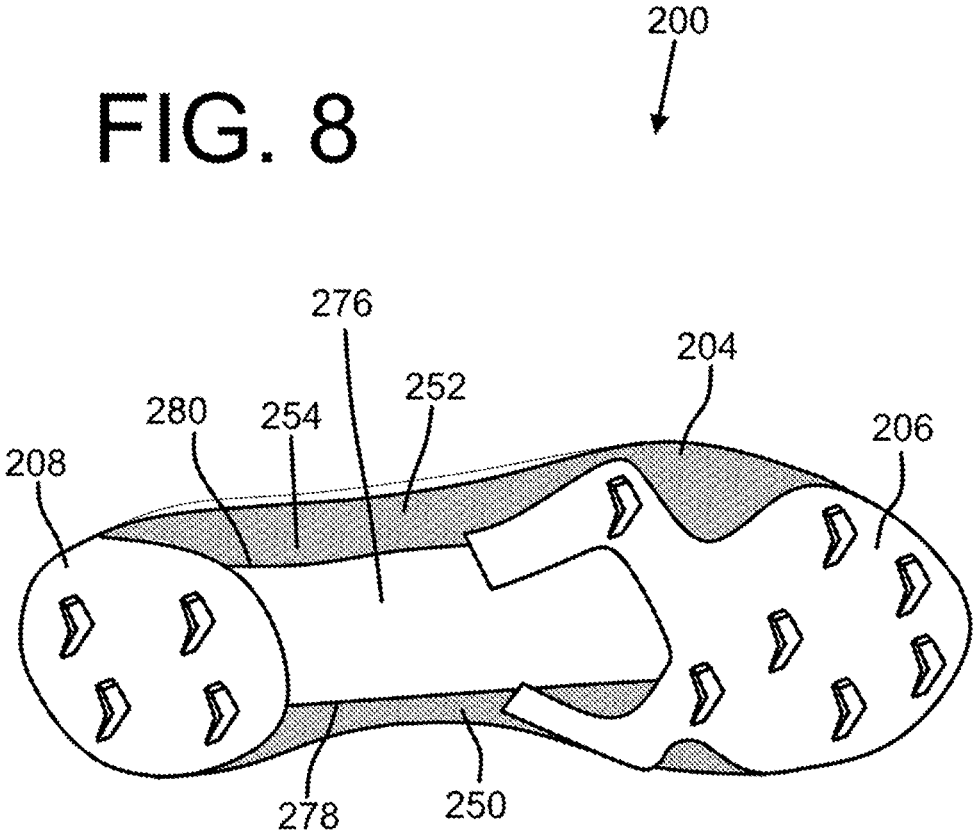
FIG. 8 is an illustration showing a bottom view of a second embodiment of an article of footwear in accordance with the present disclosure.

FIG. 8 is an illustration showing a bottom view of a second embodiment of an article of footwear 200 in accordance with the present disclosure. As shown, the article of footwear 200 may include an underfoot portion 254 with a base element 276. A lateral underfoot section 252 and a medial underfoot section 250 of the underfoot portion 254 may be formed with a knitted component in accordance with the above description and may be secured to a first edge 278 and a second edge 280 of the base element, respectively. In some embodiments, the lateral underfoot section 252 and/or the medial underfoot section 250 may continue to extend adjacent to the base element 276 (e.g., as covered by the base element 276 from the perspective of FIG. 8), and the lateral underfoot section 252 and the medial underfoot section 250 may meet to form a seam (or not). The base element 276 may be formed of any suitable material, such as a plastic material, a rubber material, a metal, a carbon fiber or other composite material, a textile material (such as a knitted material), or any other suitable material or material combination. Advantageously, the base element 276 may facilitate a strong, durable, and otherwise sufficient securement between two underfoot sections of the underfoot portion 254, between the underfoot portion 254 and at least one of a first sole structure 206 and a second sole structure 208 (or another sole structure), and/or between any other secured elements. The base element 276 may additionally or alternatively provide cushioning and protection to the plantar aspect of a foot of a wearer. In some embodiments, the base element 276 may be integral (e.g., formed integrally) with a sole structure, but this is not required. The base element 276 may be secured to the knitted component 204 during a lasting step or at another step.

Figure 9:
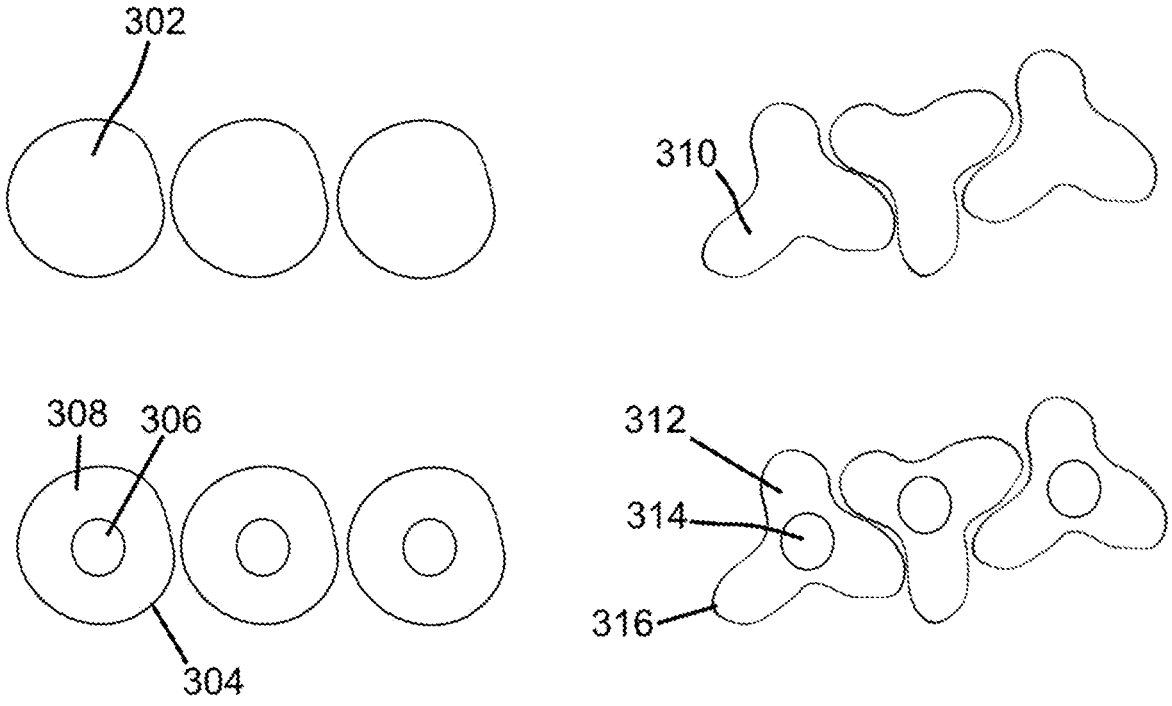
FIG. 9 shows four embodiments of yarns that may be used to form a knitted component in accordance with the present disclosure.

FIG. 9 shows four embodiments of yarns that may be used to form a knitted component in accordance with the present disclosure. The yarns depicted in FIG. 9 may be included as any of the yarns described above (e.g., the first yarn 144, the second yarn 146, and/or the third yarn 148 described above), and/or may be included as another yarn.

A first yarn type 302 may include a generally-circular cross section. The first yarn type 302 may be at least partially formed of a thermoplastic polymer material composition or another material. As shown, the first yarn type 302 may be formed substantially of a single material or material composition, and may not have a distinct core. Thus, if the first yarn type 302 is formed of a thermoplastic polymer material composition, the entirety of the first yarn type 302 may melt or at least partially melt when heated to a moderately-high temperature (e.g., a temperature somewhere in the range of 120 degrees Celsius to about 200 degrees Celsius).

A second yarn type 304 may also include a generally circular cross section. The second yarn type 304 may be at least partially formed of a thermoplastic polymer material composition or another material. As shown, the second yarn type 304 may include two distinct materials or compositions, where one material forms a core 306 and a second material forms a sheath 308. Thus, if the second yarn type 304 has a sheath 308 formed of a thermoplastic polymer material composition and a core formed of a different material (e.g., a material with a higher melting point and/or decomposition point), the sheath may melt or at least partially melt when heated to a moderately-high temperature (e.g., a temperature somewhere in the range of 120 degrees Celsius to about 200 degrees Celsius), but the core 306 may remain stable. Advantageously, the material of the sheath 308 may form a fused area as described above while the core 306 ensures that the yarn retains its desired orientation, structure, and other properties during and after the heating-processing step.

A third yarn type 310 may be similar to the first yarn type, but may have a trilobal cross section. Advantageously, yarns with trilobal cross sections may be used alone or in combination with other yarns of other cross sections to form a knitted component having desirable water resistance. As shown in FIG. 9, spaces or cavities located between yarns may be minimized by the unique cross-sectional shape of the lobes of the trilobal cross sections, which may prevent and/or limit water or other fluids from flowing from one side of an associated knitted component to another. The advantages of the trilobal shape may be enhanced when the third yarn type 310 is at least partially melted and cooled to form a fused area as described above.

Like the second yarn type 304, a fourth yarn type 312 (which has a trilobal cross section) may include a core 314 with a material that is different than a sheath 316. Thus, if the fourth yarn type 312 has a sheath 316 formed of a thermoplastic polymer material composition and a core 314 formed of a different material (e.g., a material with a higher melting point and/or decomposition point), the sheath 316 may melt or at least partially melt when heated to a moderately-high temperature (e.g., a temperature somewhere in the range of 120 degrees Celsius to about 200 degrees Celsius), but the core 314 may remain stable. Advantageously, the material of the sheath 316 may form a fused area as described above while the core 314 ensures that the yarn retains its desired orientation, structure, and other properties during and after the heating-processing step.

All of the structures and methods disclosed and claimed herein can be made and executed without undue experimentation in light of the present disclosure. While this disclosure may be embodied in many different forms, there are described in detail herein specific aspects of the disclosure. The present disclosure is an exemplification of the principles of the disclosure and is not intended to limit the disclosure to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

What is claimed is:

1. A knitted component for an article of footwear, the knitted component comprising:

an overfoot portion comprising:

a fused area, the overfoot portion of the knitted component configured to form an overfoot portion of the article of footwear, the fused area having at least a first region comprising a plurality of first courses that alternate with a plurality of second courses, each course within the plurality of first courses comprising a first yarn having a first thermoplastic polymer material composition, and each course within the plurality of second courses comprising a second yarn having a second thermoplastic polymer material composition, wherein the first thermoplastic polymer material composition has a first melting temperature, and wherein the second thermoplastic polymer material composition has a second melting temperature that is at least 20 degrees Celsius greater than the first melting temperature; and a tongue portion, comprising:

a non-fused area, the tongue portion of the knitted component configured to form a tongue of the article of footwear, the non-fused area including a third yarn having a third material composition, the third material composition having a third temperature that is greater than the first melting temperature and the second melting temperature, the third temperature being a melting temperature or a decomposition temperature of the third material composition.

2. The knitted component of claim 1, wherein the first melting temperature is 140 degrees Celsius or less, wherein the second melting temperature is 195 degrees Celsius or less, and wherein the third temperature is 200 degrees Celsius or higher.

3. The knitted component of claim 1 further comprising an underfoot portion configured to form an underfoot portion of the article of footwear, the underfoot portion of the knitted component integrally knitted with the overfoot portion of the knitted component.

4. The knitted component of claim 1, wherein the overfoot portion of the knitted component has a double knit jersey structure having an outer surface and an inner surface, wherein the fused area has the first yarn and the second yarn located on the outer surface, and wherein the inner surface includes a non-fused area.

5. The knitted component of claim 4, wherein the non-fused area of the inner surface comprises the third yarn.

6. The knitted component of claim 1, wherein the fused area of the overfoot portion further includes:

a second region comprising the first yarn and the second yarn, wherein a density of the first thermoplastic polymer material composition and a density of the second thermoplastic polymer material composition each are less in the second region than in the first region.

7. The knitted component of claim 6, wherein the second region comprises the third yarn, and wherein the third temperature is 200 degrees Celsius or higher.

8. An article of footwear comprising:

a knitted component comprising a fused area forming at least part of an overfoot portion of the article of footwear, the fused area having a first region and a second region;

the first region comprising a first yarn having a first thermoplastic polymer material composition and a second yarn having a second thermoplastic polymer material composition;

the second region comprises the first yarn and the second yarn, wherein a density of the first thermoplastic polymer material composition and a density of the second thermoplastic polymer material composition each are less in the second region than in the first region;

the first thermoplastic polymer material composition having a first melting temperature, and the second thermoplastic polymer material composition having a second melting temperature that is at least 20 degrees Celsius greater than the first melting temperature;

wherein the knitted component includes a non-fused area forming a tongue of the article of footwear, the non-fused area including a third yarn having a third material composition, the third material composition having a third temperature that is greater than the first melting temperature and the second melting temperature, the third temperature being a melting temperature or a decomposition temperature of the third material composition.

9. The article of footwear of claim 8, further comprising an underfoot portion, the fused area forming at least part of the underfoot portion.

10. The article of footwear of claim 9, wherein the fused area forming at least part of the underfoot portion has a greater thickness relative to other portions of the knitted component.

11. The article of footwear of claim 10, further comprising a first sole structure and a base element with a first edge, the base element secured to the underfoot portion at the first edge.

12. The article of footwear of claim 8, wherein a first ratio of fused thermoplastic polymer material compositions to non-fused thermoplastic polymer material compositions in the first region is at least 90:10 and wherein a second ratio of fused thermoplastic polymer material compositions to non-fused thermoplastic polymer material compositions in the second region is 50:50.

13. The article of footwear of claim 8, wherein the overfoot portion has a double knit jersey structure having an outer surface and an inner surface, wherein the fused area having the first yarn and the second yarn is located on the outer surface, and wherein the inner surface includes a non-fused area.

14. The article of footwear of claim 8, wherein the second region further comprises the third yarn.

15. The article of footwear of claim 8, wherein the non-fused area further forms a throat area of the article of footwear, and wherein the fused area further forms at least a lateral side portion of the article of footwear adjacent the throat area and at least a medial side portion of the article of footwear adjacent the throat area, a ratio of courses of the throat area to courses of the medial side portion or courses of the lateral side portion is 0.8:1 or less.

16. The article of footwear of claim 8, wherein the first region comprises a plurality of first courses that alternate with a plurality of second courses, each course within the plurality of first courses comprising the first yarn, and each course within the plurality of second courses comprising the second yarn.

17. An article of footwear comprising:

a knitted component comprising:

a fused area forming at least part of an overfoot portion of the article of footwear, the fused area having a first region and a second region, the first region comprising a plurality of first courses that alternate with a plurality of second courses, each course within the plurality of first courses comprising a first yarn having a first thermoplastic polymer material composition, and each course within the plurality of second courses comprising a second yarn having a second thermoplastic polymer material composition; and the second region comprising the first yarn, the second yarn, and a third yarn having a third material composition, the first thermoplastic polymer material composition having a first melting temperature, the second thermoplastic polymer material composition having a second melting temperature that is at least 20 degrees Celsius greater than the first melting temperature, and the third material composition having a third temperature being a melting temperature or a decomposition temperature of the third material composition; and a non-fused area forming a tongue of the article of footwear, the non-fused area including the third yarn, the third temperature being greater than the first melting temperature and the second melting temperature.

18. The article of footwear of claim 17, wherein a density of the first thermoplastic polymer material composition and a density of the second thermoplastic polymer material composition each are less in the second region than in the first region.

19. The article of footwear of claim 17, wherein the third temperature is 200 degrees Celsius or higher.

20. The knitted component of claim 1, wherein one or more of the first yarn and the second yarn comprises a core/sheath configuration.

* * * * *